US007117788B2

(12) United States Patent
Blaney et al.

(10) Patent No.: US 7,117,788 B2
(45) Date of Patent: Oct. 10, 2006

(54) SPRAY DEVICE

(75) Inventors: Ken Francis Blaney, Rochester, NH (US); Michael Thomas Woroniak, Rochester, NH (US)

(73) Assignee: Goss International Americas, Inc., Dover, NH (US)

( * ) Notice: Subject to any disclaimer, the term of this patent is extended or adjusted under 35 U.S.C. 154(b) by 0 days.

(21) Appl. No.: 10/789,121

(22) Filed: Feb. 27, 2004

(65) Prior Publication Data

US 2005/0189661 A1 Sep. 1, 2005

(51) Int. Cl.
*B41F 7/24* (2006.01)

(52) U.S. Cl. ..... 101/147; 101/132.5; 101/365; 101/366

(58) Field of Classification Search ..... 101/147, 101/132.5, 148, 365, 366
See application file for complete search history.

(56) References Cited

U.S. PATENT DOCUMENTS 4,064,801 A * 12/1977 Switall ..... 101/147
4,241,656 A * 12/1980 Smith ..... 101/148
4,708,058 A 11/1987 Smith
4,738,400 A 4/1988 Irwin
4,759,506 A * 7/1988 Moore et al. ..... 239/426
4,873,925 A * 10/1989 Hultberg et al. ..... 101/147
5,025,722 A * 6/1991 Switall et al. ..... 101/147
5,040,457 A * 8/1991 Lin ..... 101/147
5,438,923 A * 8/1995 Schoeps ..... 101/147
5,463,951 A 11/1995 Waizmann et al.
5,540,390 A 7/1996 Orzechowski et al.
6,050,186 A * 4/2000 Tomikura et al. ..... 101/147
6,098,902 A * 8/2000 Culbertson et al. ..... 239/290
6,253,677 B1 * 7/2001 Switall ..... 101/147
2004/0016827 A1 * 1/2004 Kusama et al. ..... 239/390

FOREIGN PATENT DOCUMENTS

JP 05024185 * 2/1993

* cited by examiner

*Primary Examiner*—Daniel J. Colilla
*Assistant Examiner*—Kevin D. Williams
(74) *Attorney, Agent, or Firm*—Davidson, Davidson & Kappel, LLC

(57) ABSTRACT

A spray device for a printing press includes a liquid inlet orifice for receiving a liquid, a gas inlet orifice for receiving a gas disposed downstream from the liquid inlet orifice, and an exit orifice disposed at a distance from a surface of the printing press. In addition, a method for applying a liquid to a surface of a printing press, includes the steps of providing a liquid to a liquid inlet orifice of a spray device, providing a gas to a gas inlet orifice of the spray device; and spraying a mixture of the liquid and gas onto the surface of the printing press.

19 Claims, 4 Drawing Sheets

SPRAY DEVICE

BACKGROUND OF THE INVENTION

The present invention relates generally to printing presses and more particularly to a spray device on a printing press for spraying a surface of the press.

Spray devices have been used in conjunction with offset printing machines, especially web offset printing machines, to apply liquid to a cylinder surface. A plurality of spray devices are typically mounted on a spray bar, which holds the spray devices at a distance from a surface of the cylinder. Spray devices are used to dampen the plate cylinder with water or a fountain solution as part of the printing process. Typically, the spray devices spray the liquid directly onto a surface of a dampening cylinder. A train of two more dampening cylinders is then used to spread the liquid into a continuous film and to transport the liquid to the plate cylinder. The liquid adheres to the hydrophilic areas on the surface of the plate cylinder to resist the deposition of ink on those areas. Spray devices may also be used for other applications on the printing press, for example, to clean and/or cool other surfaces of the printing press.

U.S. Pat. No. 4,738,400 discloses an elongated spray bar for cooling rollers in a metal rolling machine. The spray bar assembly includes a plurality of nozzles mounted in a bottom plate of the spray bar and independent fluid passageways are defined in the intermediate and top plates of the spray bar.

U.S. Pat. No. 4,708,058 discloses a water pulse spray dampening system for a printing press. The dampening system includes a plurality of spray nozzles disposed on a spray bar. Solenoid valves associated with each nozzle are cycled to open and close the flow of liquid through the nozzles, for example, at a rate of 350 pulses per minute at a full press speed, with the fluid pressure being maintained at 40 psig.

U.S. Pat. No. 5,540,390 discloses a spray bar assembly for a printing press having at least one nozzle and means for selectively opening and closing flow of a liquid through the nozzle. A pair of opposed side walls housing the nozzle help to control the spray of liquid.

U.S. Pat. No. 5,463,951 discloses a printing machine spray device for moistening surfaces of a printing press. The spray device enables small amounts of water to be distributed uniformly over a large surface by moving sprayers of the device relative to the surface as they are spraying.

SUMMARY OF THE INVENTION

An object of the present invention is to provide a spray device for applying liquid to a printing press while reducing waste and/or misting.

The size and composition of the liquid droplets within a spray distribution can affect the characteristics and effectiveness of the spray. Droplets that are too small contribute to misting, and may never reach the surface of the dampening roll. In addition, droplets that are too large or dense may cause splash-back when they strike the cylinder surface. This occurs when, upon impact of the droplet with the surface, a portion of the liquid does not adhere to the cylinder, but instead splashes away from the cylinder. Fountain solutions used with printing presses typically include chemicals designed to reduce the surface tension of the liquid to provide better spreading and coating properties on the plate cylinder. The reduction in surface tension, however, also tends to decrease droplet size in the spray, and thus increase misting and the resultant waste of the liquid during use. The flow rate of the liquid and the geometry of the nozzle can also affect droplet size as well as the spray pattern exiting the nozzle. Spray nozzles used to apply liquid to a dampening cylinder are typically adapted for very low rates of liquid flow, on the order of a few milliliters per second when the nozzle is fully opened.

The present invention provides a spray device for a printing press comprising: a liquid inlet orifice for receiving a liquid, a gas inlet orifice for receiving a gas disposed downstream from the liquid inlet orifice, and an exit orifice disposed at a distance from a surface of the printing press, such as a surface of a dampening cylinder. The spray device, thus allows for the entrainment of a gas, such as air, into the liquid before the mixture is sprayed toward the surface of the printing press.

The spray device may also include an internal passage communicating with the liquid inlet orifice, the gas inlet orifice, and the exit orifice. Particularly for liquids having low surface tensions, the presence of tiny gas bubbles may improve the characteristics of the spray, such as by creating clusters of droplets that have more mass and are less susceptible to drifting.

Preferably, the spray device includes an insert member which defines the liquid inlet orifice, the gas inlet orifice, and at least a portion of the internal passage. In addition, a separate nozzle tip may define the exit orifice and be disposed at a downstream end of the insert member. The internal passage may be defined by both the insert member and the nozzle tip. Gas and liquid may be mixed in the internal passage to form a gas-liquid mixture. A body member having a liquid conduit is preferably disposed upstream from the insert member so that the liquid conduit communicates with the liquid inlet orifice. The spray device may include a valve element, preferably actuated by a solenoid, for repeatedly interrupting a flow of the liquid through the body, so that a pulsed spray exits from the spray device.

By having an insert member defining the gas and liquid inlet orifices and a separate nozzle tip defining the exit orifice of the spray device, the size and shape of the inlet orifices can be controlled separately from the exit orifice. Thus, the flow rate of the liquid and/or the gas into the nozzle, which is primarily controlled by the size of the respective inlet orifices, can be controlled separately from the characteristics of the spray pattern, which is primarily controlled by the geometry of the exit orifice in the nozzle tip. By replacing the insert member with a different insert member having a smaller liquid inlet orifice, for example, the liquid flow rate through the nozzle may be reduced. The nozzle tip may also be replaced to include an exit orifice with the appropriate size and geometry to accommodate the reduced flow rate and to produce an optimal spray pattern for that reduced flow rate. The nozzle tip is preferably held adjacent to the insert member by a connecting device, such as a screw cap, that is removeably attached either to the insert member itself or to the body member of the spray device, to provide for readily changing the nozzle tip and/or the insert member.

The surface of the printing press may include a portion of a dampening cylinder, the liquid may be water, or an aqueous fountain solution that includes substances for providing a low surface tension of the liquid. The gas is preferably air at atmospheric pressure. Because the gas inlet orifice is disposed upstream from the liquid inlet orifice, the spray device acts as a venturi nozzle assembly drawing the air into the spray device because of the low pressure at an inside edge of the gas inlet orifice caused by the rushing of the liquid past that gas inlet orifice. However, the gas may also be a gas other than air and may be supplied to the gas inlet orifice under a pressure that is greater than atmospheric pressure.

The present invention also provides a printing press comprising a spray device as described above.

In addition, the present invention provides a method for applying a liquid to a surface of a printing press, the method comprising:

providing a liquid to a liquid inlet orifice of a spray device;

providing a gas to a gas inlet orifice of the spray device; and spraying a mixture of the liquid and gas onto the surface of the printing press.

The method may also include the step of repeatedly interrupting a flow of liquid through the spray device so as to cause the spraying to be performed in a pulsed fashion.

The method may also include controlling a flow rate of the liquid through the spray device by changing a size of the liquid orifice, and/or controlling a flow rate of gas through the spray device by changing a size of the gas inlet orifice. The spraying is preferably performed using an outlet orifice of the spray device, and a spray pattern of the spray may be affected by selecting a size and/or a shape of the outlet orifice.

BRIEF DESCRIPTION OF THE DRAWINGS

The following figures show a preferred embodiment of the present invention in which.

DETAILED DESCRIPTION OF A PREFERRED EMBODIMENT

Figure 1:
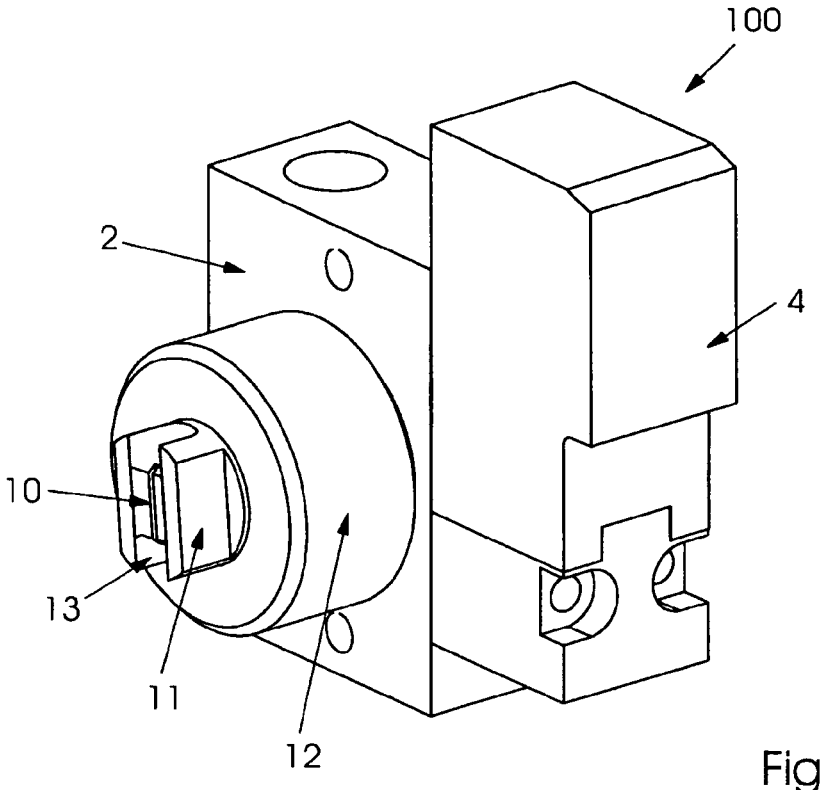
FIG. 1 shows a perspective view of an embodiment according to the present invention of a spray device for a printing press.
Figure 2:
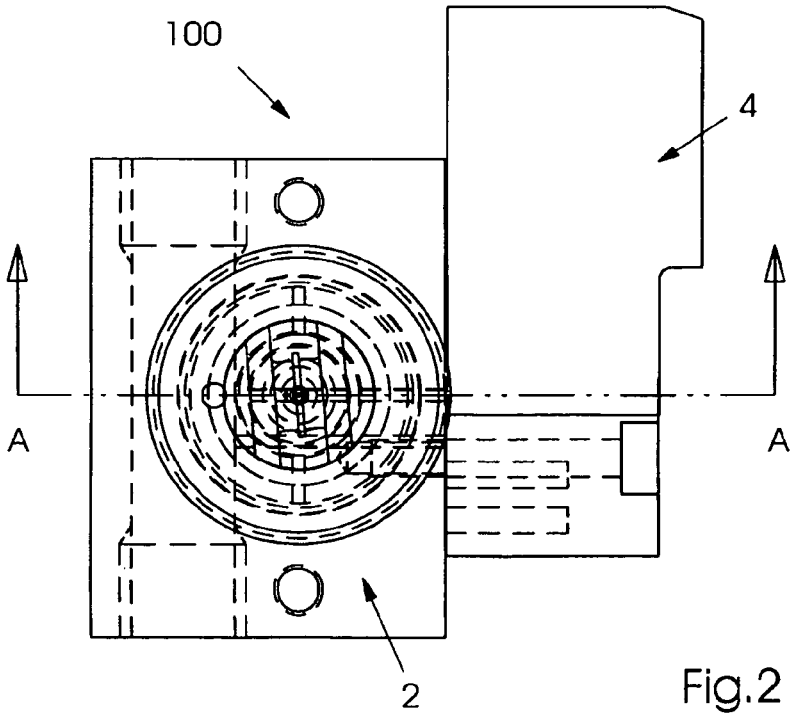
FIG. 2 shows a front view of the spray device of FIG. 1.

FIGS. 1 and 2 show an exemplary embodiment of a spray device 100 of the present invention. Screw cap 12 is threaded onto body member 2 and holds nozzle tip 11 in place. Exit orifice 10 is visible on the front on spray device 100 as is flat-bottom slot 13. Solenoid 4 is mounted to the side of body 2 for actuating a valve element 16 inside of solenoid 4, to repeatedly interrupt a flow of liquid through the spray device and cause pulsed spraying.

Figure 3:
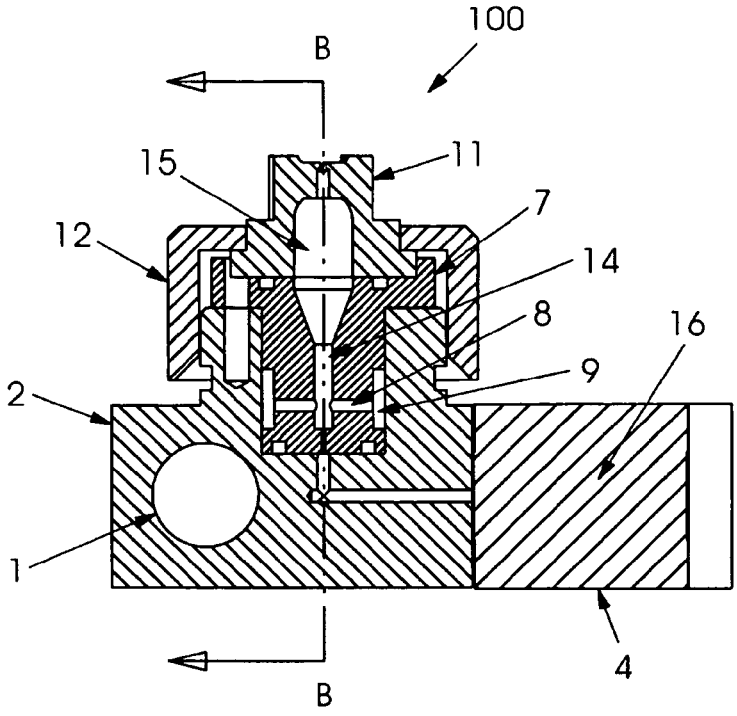
FIG. 3 shows a sectional view through the line A—A of FIG. 2.
Figure 4:
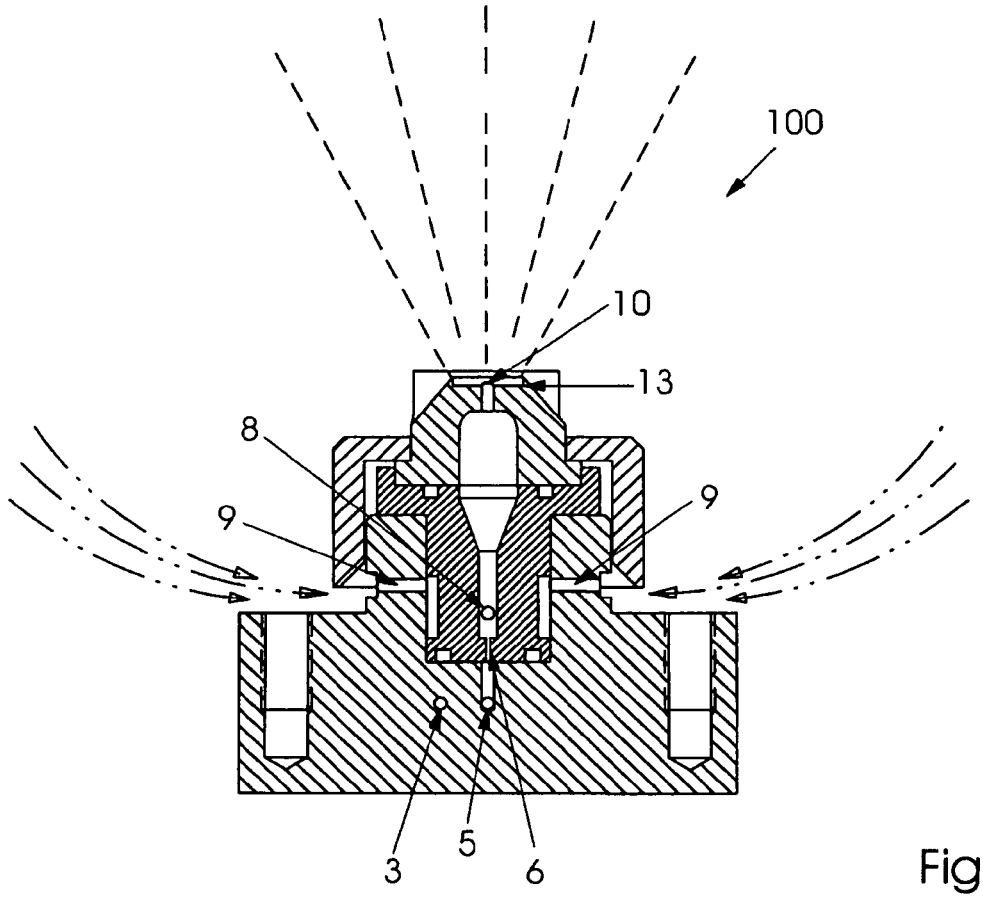
FIG. 4 shows a shows a sectional view through the line B—B of FIG. 3.

The paths of the liquid and gas through the spray device are visible in the sectional views of FIG. 3 (showing a sectional view through line A—A of FIG. 1) and in FIG. 4 (showing a sectional view through line B—B of FIG. 3). A liquid enters the body member 2 through liquid supply conduit 1. Where the spray device is used for dampening a plate cylinder on a printing press, the liquid is typically a fountain solution of water that includes additives to reduce its surface tension. In other applications of the spray device, the liquid may also be a cleaning solution, a coolant, or some other liquid.

The liquid may reach supply conduit 1 through a pipe or hose from a liquid source, which may also supply other spray devices, and is preferably under pressure. The liquid travels from liquid conduit 1, through valve conduit 3, where it is metered by a valve element 16 actuated by solenoid 4. When the valve element 16 is opened, liquid travels through liquid conduit 5 and is received by liquid inlet orifice 6 of insert member 7. The geometry of liquid inlet orifice, particularly the size of its diameter, determines the flow rate of liquid through the spray device when the valve element 16 is opened.

From liquid inlet orifice 6, the liquid flows into internal passage 14 and past gas inlet orifice 8. The rushing of the liquid past the gas intake orifice 8 causes a drop in pressure in gas supply conduit 9, thus causing gas to enter the internal passage 14 through the gas inlet orifice 8 through what is known as the venturi effect. In this embodiment, the gas is air outside of the spray device at atmospheric pressure.

The internal passage 14 is formed by a portion of the insert member 7 and preferably extends into a portion of the nozzle tip 11. Preferably, the internal passage widens to include an enlarged region 15 of internal passage 14. Enlarged region 15 acts as a mixing chamber of the spray device, where the air can become entrained in the liquid, preferably in the form of tiny air bubbles, before the air-liquid mixture exits the spray device through exit orifice 10 of nozzle tip 11.

The insert member 7 and nozzle tip 11 are separate components held in place by screw cap 12, which is threaded onto an extension portion of body 2, so that exit orifice 10 and the portion of internal passage 14 in the nozzle tip are aligned with the portion of the internal passage 14 defined by the insert member 7. In addition, the geometry of the front portion of body 2 is configured to receive insert member 7 so that the liquid inlet orifice 6 is aligned with the liquid conduit 5 within body 2. A plurality of gas supply conduits 9 exit body 2 behind the screw cap 12. This configuration allows for the screw cap 12 to be easily removed so that either the nozzle tip 11 or insert member 7 can be readily removed and replaced to change the characteristics of the spray, such as the liquid or gas flow rate or the spray pattern geometry.

Figure 5:
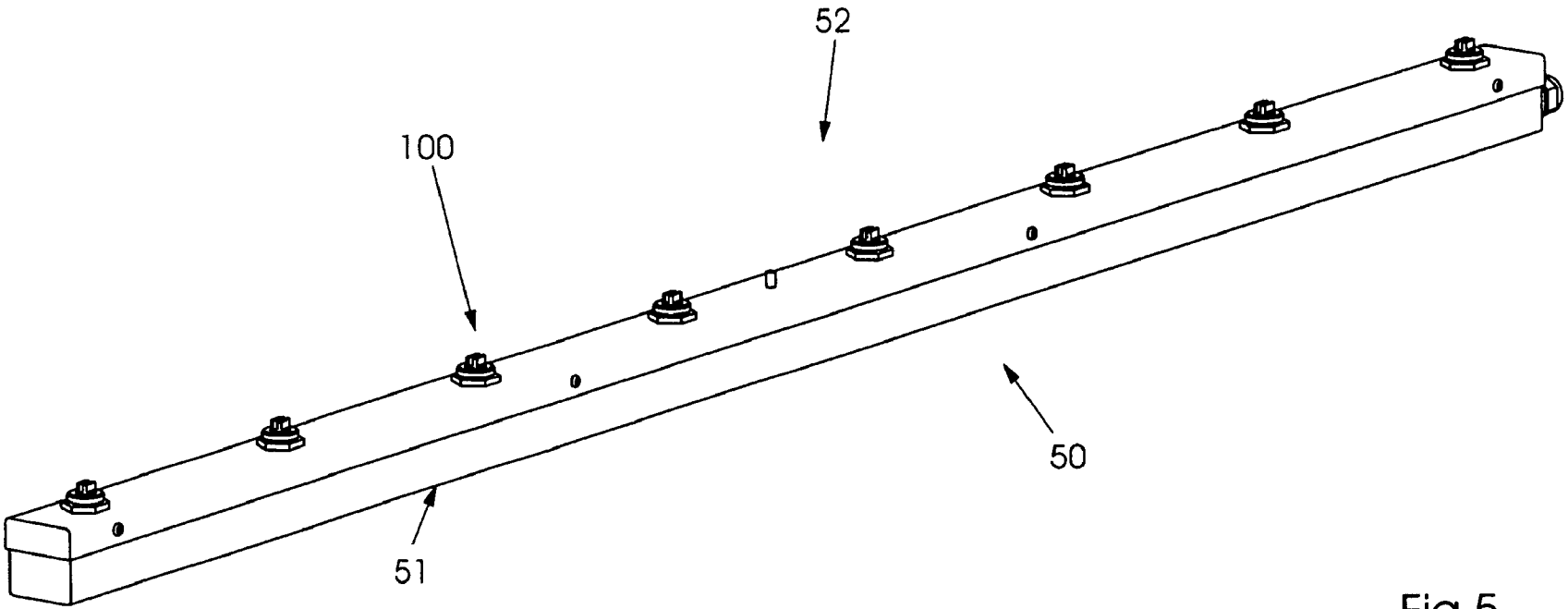
FIG. 5 shows a perspective view of a plurality of spray devices disposed on a spray bar.

FIG. 5 shows a spray bar assembly 50, which includes eight spray assemblies 100, mounted on the spray bar such that most of the spray devices 100 are enclosed within the spray bar 51. The geometry of exit orifice 10, which includes flat-bottom slot 13 (see FIG. 4), primarily determines the spray pattern of the liquid exiting the spray device 100. The spray patterns 52 formed by the spray of each spray device 100, shown schematically in FIG. 5, are typically flat fan-shaped patterns. The spray bar assembly 50, is typically mounted longitudinally at a distance from a cylinder surface, so that the ends of the flat fan pattern slightly overlap, in attempt to maximally cover the surface of the cylinder with the liquid.

Figure 6:
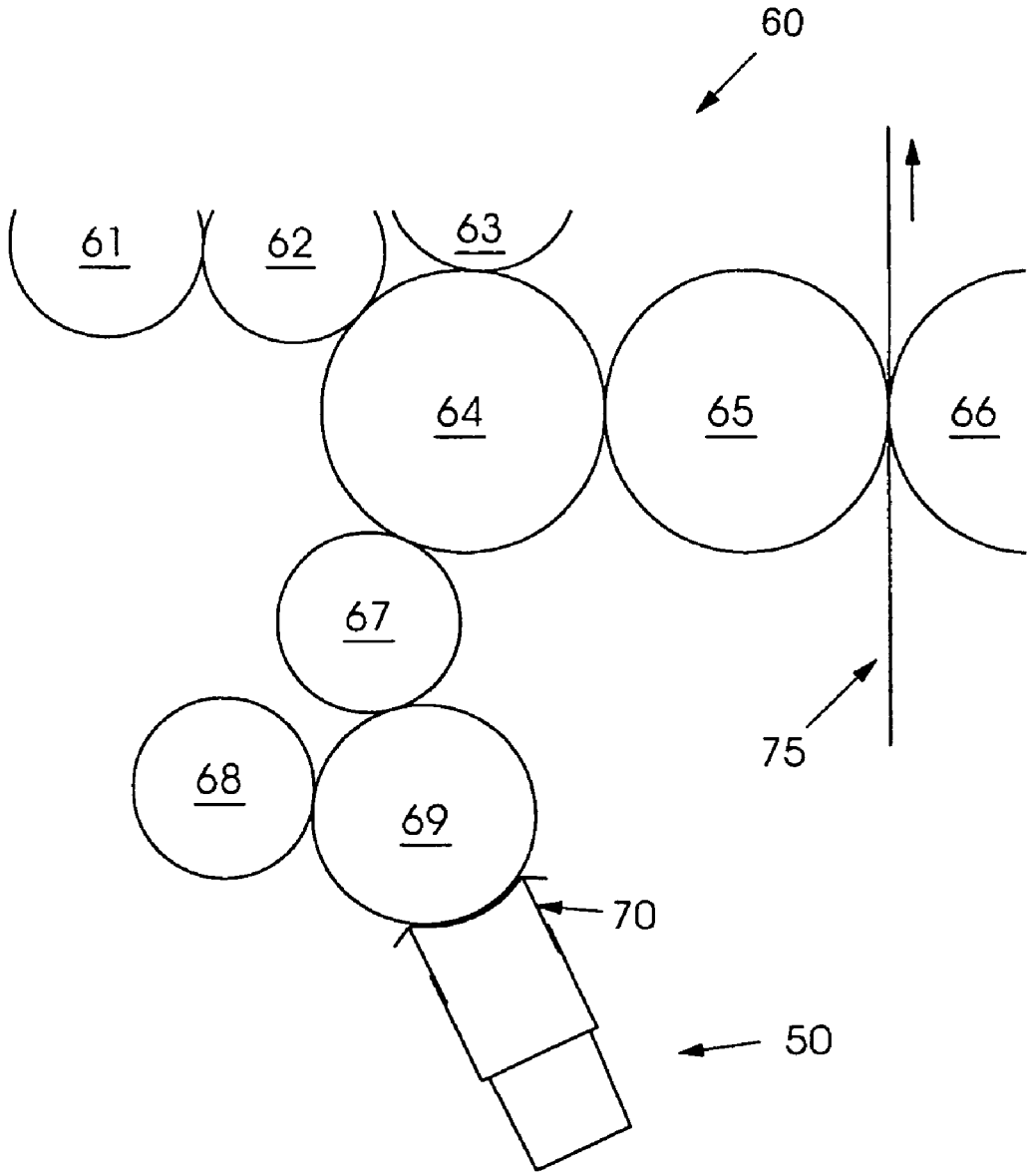
FIG. 6 shows a schematic side view of a portion of a printing press having the spray bar of FIG. 5 mounted thereon.

FIG. 6 shows a schematic side view of a portion of a printing press 60. A continuous web of material 75 is passed between two blanket cylinders 65, 66 and is printed on both sides with a plurality of ink images, transferred from the blanket cylinders 65, 66. The image is deposited onto blanket cylinder 65 (in mirror image form) by plate cylinder 64, which has been etched with the image. The plate cylinder 64 includes hydrophilic areas (in those areas that are not etched) as well as hydrophobic areas in the areas that are etched. As plate cylinder 64 rotates, it receives a film of liquid fountain solution from a dampening train of cylinders (including dampening cylinders 67, 68, 69). The film of liquid fountain solution adheres to the hydrophilic areas of the plate cylinder 64. As plate cylinder further rotates, it receives a film of ink from an ink train (including ink cylinders 61, 62 and 63), which adheres only to the etched, hydrophobic surfaces that do not include the liquid. Upon further rotation of plate cylinder 64, the ink image is then transferred to the blanket cylinder 65.

The liquid fountain solution is applied onto dampening cylinder 69 from spray bar assembly 50 that includes spray bar 51 and the plurality of spray devices 100. Spray bar assembly 50 is preferably mounted so that the exit orifices 10 of the spray devices are at a distance on the order of several centimeters from the surface of dampening cylinder 69. The spray bar assembly 50 may also include a shroud 70 mounted on the spray bar 51 and disposed very near, so as to be nearly touching the dampening cylinder 69 when the spray assembly is in spraying position to minimize the amount of open space available for mist of the spray to escape. The shroud 70 also acts to collect any the liquid that does not adhere to the dampening cylinder 69, which may exit the shroud 70 through a drain.

What is claimed is:

1. A spray device for a printing press comprising:

a liquid inlet orifice for receiving a liquid;

a gas inlet orifice for receiving a gas disposed downstream from the liquid inlet orifice;

an exit orifice disposed at a distance from a surface of the printing press, the surface facilitating a printing operation; and an internal passage communicating with the liquid inlet orifice, the gas inlet orifice and the exit orifice, the internal passage including a mixing chamber for entraining the gas in the liquid; the mixing chamber being defined by an enlarged region of the internal passage, the internal passage being narrower than the enlarged region downstream from the mixing chamber, the entrained liquid-gas mixture exiting through said orifice and contacting the surface of the printing press.

2. The spray device as recited in claim 1, wherein the liquid inlet orifice, the gas inlet orifice, and at least a portion of the internal passage, are defined by an insert member.

3. The spray device as recited in claim 2, wherein the exit orifice is defined by a nozzle tip disposed at a downstream end of the insert member.

4. The spray device as recited in claim 3, wherein the internal passage is defined by the insert member and the nozzle tip.

5. The spray device as recited in claim 3, further comprising a body member having a liquid conduit and disposed at an upstream end of the insert member so that the liquid conduit communicates with the liquid inlet orifice.

6. The spray device as recited in claim 5, further comprising a valve element for enabling a pulsed flow of the liquid through the body.

7. The spray device as recited in claim 6, further comprising a solenoid configured to actuate the valve element.

8. The spray device as recited in claim 1, wherein the surface of the printing press includes a portion of a dampening cylinder.

9. The spray device as recited in claim 1, wherein the liquid is at least one of water and an aqueous fountain solution.

10. The spray device as recited in claim 1, wherein the gas is air.

11. The spray device as recited in claim 1, wherein the gas provided to the gas inlet orifice is at atmospheric pressure.

12. The spray device as recited in claim 1, wherein the gas outside the gas inlet orifice is pressurized to a pressure greater than atmospheric pressure.

13. The spray device as recited in claim 5, further comprising a connecting device removably attached to one of the insert member and the body member for holding the nozzle tip adjacent to the insert member.

14. A printing press comprising a spray device according to claim 1.

15. A method for applying a liquid to a surface of a printing press, the method comprising:

providing a liquid to a liquid inlet orifice of a spray device;

providing a gas to a gas inlet orifice of the spray device;

providing an exit orifice disposed at a distance from the surface of the printing press, the surface facilitating a printing operation;

providing an internal passage communicating with the liquid inlet orifice, the gas inlet orifice and the exit orifice, the internal passage including a mixing chamber for entraining the gas in the liquid, the mixing chamber being defined by an enlarged region of the internal passage, the internal passage being narrower than the enlarged region downstream from the mixing chamber;

entraining the gas in the liquid in the mixing chamber so as to form a mixture of the liquid and the gas in which the gas is entrained in the liquid; and spraying the mixture of the liquid and gas through the exit office and onto the surface of the printing press.

16. The method as recited in claim 15, further comprising repeatedly interrupting a flow of liquid through the spray device so as to cause the spraying to be performed in a pulsed fashion.

17. The method as recited in claim 15, further comprising controlling a flow rate of the liquid through the spray device by changing a size of the liquid orifice.

18. The method as recited in claim 15, further controlling a flow rate of gas through the spray device by changing a size of the gas inlet orifice.

19. The method as recited in claim 15, wherein the spraying is performed using an outlet orifice of the spray device, and further comprising selecting at least one of a size and a shape of the outlet orifice so as to affect a spray pattern.

* * * * *

UNITED STATES PATENT AND TRADEMARK OFFICE

CERTIFICATE OF CORRECTION

PATENT NO. : 7,117,788 B2
APPLICATION NO. : 10/789121
DATED : October 10, 2006
INVENTOR(S) : Ken Francis Blaney and Michael Thomas Woroniak It is certified that error appears in the above-identified patent and that said Letters Patent is hereby corrected as shown below:

Column 6, line 42, “office” should be changed to --orifice--.

Signed and Sealed this

Ninth Day of January, 2007

JON W. DUDAS
*Director of the United States Patent and Trademark Office*